United States Patent [19]

Staats et al.

[11] 3,973,787

[45] Aug. 10, 1976

[54] BOOKBINDING SYSTEM

[75] Inventors: Henry N. Staats, Deerfield; Robert K. Newcomb, Wilmette, both of Ill.

[73] Assignee: General Binding Corporation, Northbrook, Ill.

[22] Filed: May 15, 1975

[21] Appl. No.: 577,860

Related U.S. Application Data

[63] Continuation of Ser. No. 371,550, June 19, 1973, abandoned.

[52] U.S. Cl. ..... 281/21 R; 156/212

[51] Int. Cl.[2] ..... B42D 1/04

[58] Field of Search ..... 281/21 R, 29, 3; 11/1 R; 156/212

[56] References Cited

UNITED STATES PATENTS

| | | | |
|---|---|---|---|
| 2,762,066 | 9/1956 | Meyer | 281/21 R |
| 3,093,396 | 6/1963 | Segreto | 281/21 R |
| 3,161,423 | 12/1964 | Hertzberg | 281/29 |
| 3,518,143 | 6/1970 | Fuhr | 156/212 |

FOREIGN PATENTS OR APPLICATIONS

| | | | |
|---|---|---|---|
| 1,536,488 | 1/1970 | Germany | 281/21 |

*Primary Examiner*—Jerome Schnall
*Attorney, Agent, or Firm*—Hill, Gross, Simpson, Van Santen, Steadman, Chara & Simpson

[57] ABSTRACT

A method and apparatus for permanently binding a plurality of sheets along one edge by embedding them in a thermally activatable adhesive. The sheets are slashed in the presence of the adhesive in a manner providing contact of the adhesive with the sides as well as the edges of the sheets to be bound providing a permanent securement of each sheet. Apparatus accomplishing the binding operation as well as a novel universally usable cover and method of use thereof are encompassed in the invention.

5 Claims, 27 Drawing Figures

BOOKBINDING SYSTEM

This is a continuation, of application Ser. No. 371,550, filed June 19, 1973. Now abandoned.

BACKGROUND OF THE INVENTION

As those familiar with the stationery arts are aware, sheets of paper, or the like, have been found together at one edge through the medium of resilient adhesive. A well-known example of this technique is seen in the typical "pad" of paper in which the individual sheets are sequentially usable, and removable from the pad by physical disengagement from the adhesive. In such binding systems, the sheets have been physically clamped to provide a maximum compression adjacent the edge to be supplied with adhesive. With the clamped sheets thus positioned, an adhesive material has been applied to the exposed edge. Such a system has been similarly applied to pamphlets, books, and the like, utilizing apparatus designed to first stack the sheets in aligned condition and then rigidly clamp the sheets adjacent the edge to be glued. Many books have been bound utilizing such prior art systems. However, for typical office or home use, the apparatus envisaged for such binding procedures has been extremely expensive and has required relatively skilled personnel for its successful operation. In the main, bookbinding done under such circumstances has required large manufacturing facilities and has been done on a high-volume basis only. At the same time, means have continually been sought permitting simple edge-binding. Although simplifications have been attempted in the formerly employed clamping systems, continued research has failed to develop any simple adhesive-type bookbinding system readily incorporated in an ordinary office and home operation.

SUMMARY OF THE INVENTION

In accordance with the present invention, a thermally activatable adhesive is combined with a loosely gathered sheaf of sheets. The gathered sheets are jogged or otherwise aligned so that the edge thereof to be bound lies horizontally upon a layer of adhesive positioned on a backbone. Typically, this alignment and positioning is accomplished while the adhesive is in a non-activated state so that positioning adjustments may readily be made without interference by the adhesive material. Heat is applied to the adhesive and during the heating operation the sheets are slashed or, in other words, slid back and forth over one another so that the adhesive material contacts small exposed portions of the sides of each of the sheets immediately adjacent the edge being bound. It has been found that adhesive is quite uniformly brought into contact with the sides of the individual sheets and upon cooling of the adhesive, the sheets and backbone are permanently secured together. No appreciable clamping pressure is employed against the sheets during the binding operation, in order to facilitate the sheet-slashing step. Accordingly, apparatus of a relatively inexpensive and yet highly efficient, nature, is permitted.

The present invention encompasses a novel cover having as a part thereof a normally non-adhesive, heat-reactivatable adhesive material, which cover is available as a sales item in its own right. Individuals desiring to maintain a permanent file of documents may acquire a binder or cover, jog, or otherwise align a plurality of sheets therein and apply heat by a number of household sources. By providing slashing, as is hereinafter more fully described, a permanent, bound, file, is readily provided. Further, through the utilization of a thermoplastic adhesive, additional sheets may readily be inserted into the bound cover by reheating the adhesive material and positioning the additional sheets in contact therewith. Accordingly, in accordance with the present invention, a "looseleaf," yet permanently bound volume is provided which we have found is substantially indestructible in normal use, and yet is readily amenable to disassembly and reassembly where desired. Further, the method and apparatus employed in providing this bookbinding system is so simple and inexpensive that it may be made available to the smallest office or home use at modest expense and with a miminum of instruction.

Accordingly, it is an object of the present invention to provide a novel method of binding loose sheets of paper, or the like;

A further object of the present invention is to provide a novel apparatus for the thermal binding of books, and A further object of the invention is to provide a novel book cover and book product.

DETAILED DESCRIPTION

Figure 1:
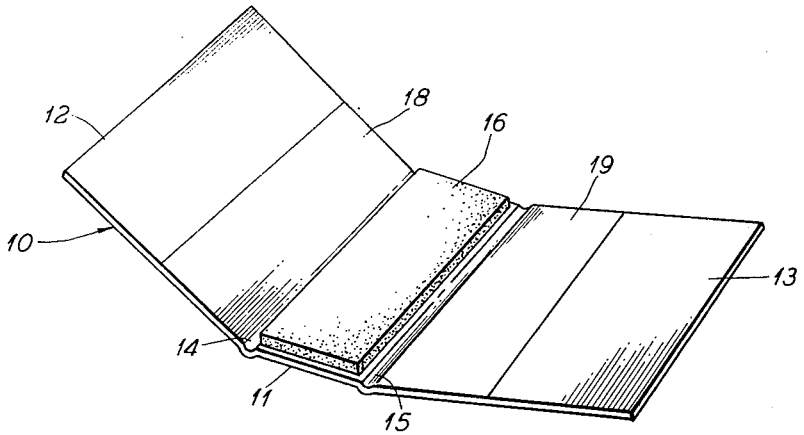
FIG. 1 is an isometric view of an adhesive book cover in accordance with the present invention.
Figure 2:
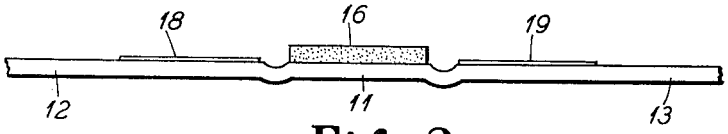
FIG. 2 is an end-elevational view of the adhesive cover shown in FIG. 1.
Figure 3:
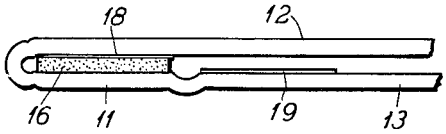
FIG. 3 is an end-elevational view of the adhesive cover shown in FIG. 2 but with one cover portion folded over the backbone as in a storage condition.
Figure 4:
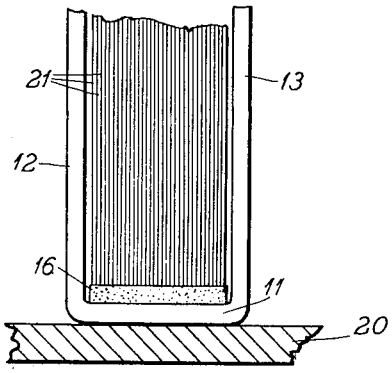
FIG. 4 is a partial end-elevation of a book bound in accordance with the present invention, and in position over a thermal heater element.

An adhesive cover constructed in accordance with the present invention is illustrated in FIGS. 1 and 2. As there shown, a book cover, generally indicated at 10, is provided with a backbone 11 and respective front and back cover members 12 and 13. The cover is scribed along lines 14, 15 to provide localized flexing. A thermally activatable adhesive layer 16 is positioned against the backbone 11 and, in the preferred form of the invention is mechanically or adhesively secured to the backbone. The portion of the covers 12 and 13 adjacent the backbone are coated with a release coating generally shown at 18, 19 and covering a dimension slightly wider than the dimension of the backbone adhesive 16 so that when the cover is folded for shipment or storage, as shown in FIG. 3, any tendency of the adhesive material 16 to secure itself to the cover at storage temperatures will be prevented. When the binders are to be shipped or stored in open, flat, condition, the release coating may be applied directly onto the adhesive 16. The cover with assembled pages is generally illustrated in FIG. 4.

Figure 5:
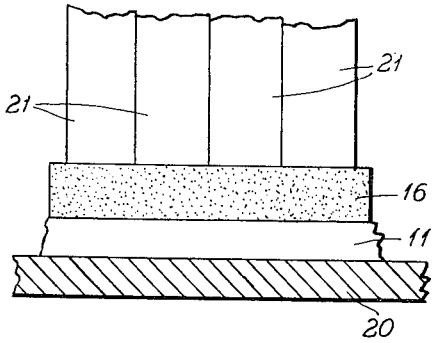
FIG. 5 is an enlarged schematic illustration of the adhesive cover of the present invention immediately prior to the binding operation.
Figure 6:
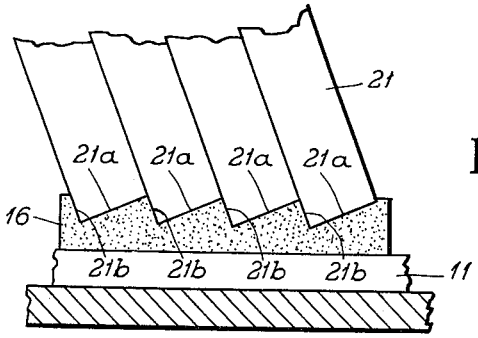
FIGS. 6 and 7 illustrate intermediate slashing steps employed in accordance with the present invention.
Figure 7:
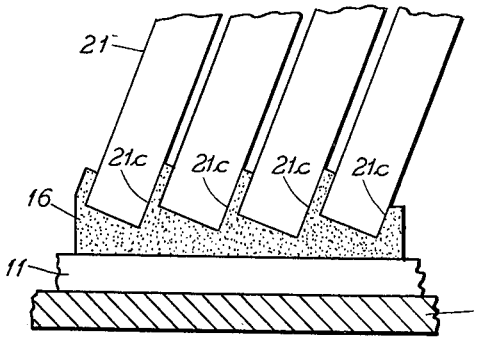

The mechanical operation of the present invention can be best understood from a consideration of FIGS. 5– 8 which schematically illustrate the novel binding technique. As shown in FIG. 5, the backbone 11 is placed upon a heater 20 with the adhesive 16 supporting a plurality of paper sheets 21. Heat is applied to the adhesive 16 by the heater 20, through the cover backbone 11 to a point at which the adhesive softens and flows. At this state, the pages are tilted relative to the backbone 11 as shown in FIG. 6, causing the sheets to slash or slide relative to each other exposing their lower left-hand sides immediately adjacent the edges to be bound. As illustrated, the edges 21*a* are in contact with the adhesive 16 and, as shown in FIG. 6, the left-hand side portions 21*b* are exposed by the left-hand tilting or slashing motion. A reverse tilt or slashing motion as shown in FIG. 7 causes the right-hand side portions 21*c* to become exposed to the adhesive and, at the same time, causes adhesive in contact with the sides 21*b* to be drawn between adjacent sheets. A centering or neutralizing action, shown in FIG. 8, causes the book to assume a condition in which the edges 21*a* and all of the sides 21*b*, 21*c*, are contacted by the adhesive, with the pages being essentially embedded and firmly, individually, grasped by the adhesive 16.

It will be seen from a consideration of the actions above described, that it is desirable in accordance with the present invention that the pages not be clamped tightly together adjacent their bound edges. This is true since it is desirable that a slight amount of the adhesive contact the sides of the individual sheets. It is desirable, however, that the individual sheets be held together somewhat so that they will assume a relatively uniform book configuration but at the same time will readily slide relative to each other to permit the slashing or wave action to occur.

Figure 8:
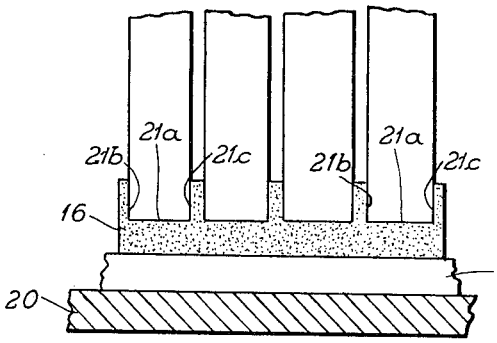
FIG. 8 is an end-elevational view, enlarged, showing the final, bound, book.
Figure 9:
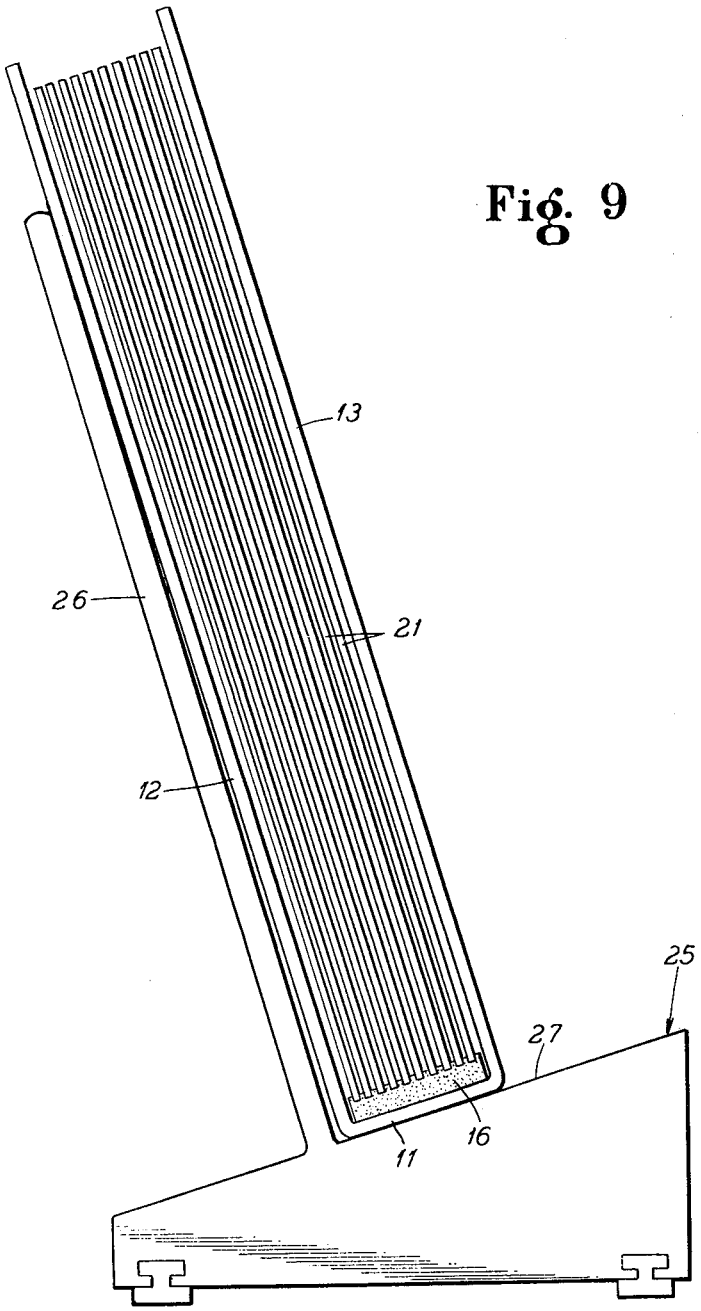
FIG. 9 is an end-elevational view of a chill block conveniently employed with the bookbinding method of the present invention.

Immediately following the final positioning as shown in FIG. 8, the book should be cooled in a condition in which the pages are substantially perpendicular to the backbone. This may be accomplished by discontinuing the source of heat to the heater or, alternatively, by transporting the book to a place where it may be cooled in a proper position Such an arrangement is shown in FIG. 9 where a chilling block 25 is provided with retaining wall 26 tilted away from the vertical to permit the bound book to rest with the backbone 11 upon surface 27. The surface 27 is perpendicular to the wall 26 so that the book maintains its proper rectilinearity during cooling. For this purpose it is preferred that the chilling block be constructed of aluminum, copper, or some other material capable of dissipating heat rapidly.

The bookbinding method described above may be accomplished by hand employing a cover such as illustrated in FIG. 1 on a flat heater 20. In such accomplishment of the method, the back and forth slashing of the papers may be accomplished while relatively loosely grasping the covers 12 and 13 with the papers to be bound lying loosely therein. It will be seen, accordingly, that books may be bound utilizing the present cover and adhesive wherever a thermally controllable hot plate is available. However, for practical office use, high quality binding may readily be accomplished by apparatus maintaining the general position of the book in an upright condition while oscillating the support therefor to provide the appropriate slashing. Such an apparatus is shown in FIGS. 10 and 11.

Figure 10:
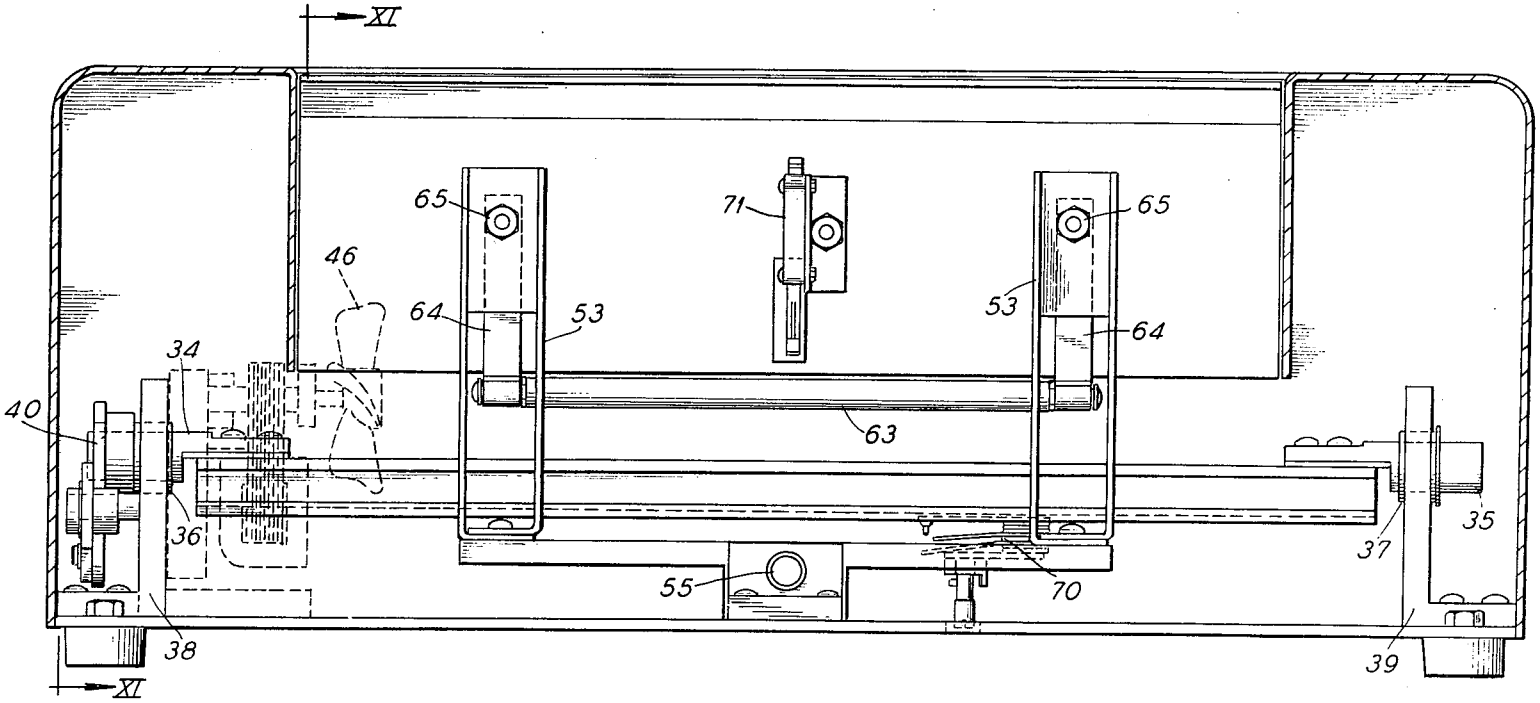
FIG. 10 is a side elevational view of an apparatus that has successfully been employed in the bookbinding system of the present invention.
Figure 11:
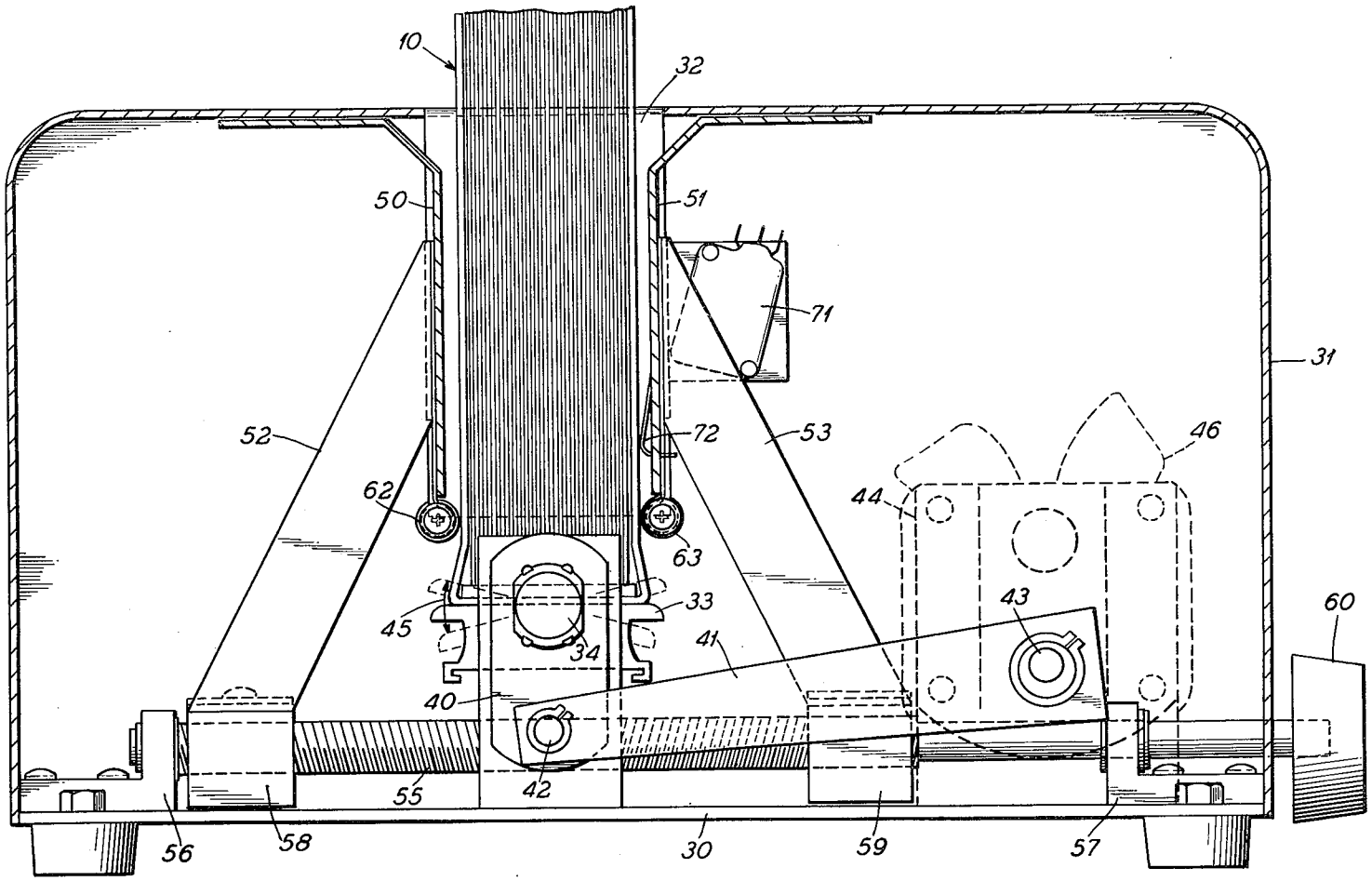
FIG. 11 is a cross-sectional view of the apparatus shown in FIG. 10 and taken along line XI—XI thereof.

The apparatus shown in FIGS. 10 and 11 comprises a base 30 and a sheet metal cover 31 surrounding the internal mechanism of the apparatus and providing an overhead opening 32 into which a book may be inserted, as illustrated in FIG. 11. The book 10 rests upon heater 33 pivotally carried on trunnions 34, 35 carried in respective bushings 36, 37 in supports 38, 39. A link 40 is fixedly secured to trunnion 34 and is in turn oscillated by connecting rod 41, via pin 42. The connecting rod 41 is rotatably mounted on eccentric 43 to shaft 43*a* of motor 44 to provide oscillation of the heater 33 through the path generally indicated by the arrows 45, in FIG. 11. The motor may be of any conventional configuration, preferably having a cooling fan 46. We have found that drive systems providing for oscillation of the heater 33 through full cycle at the rate of approximately 70 oscillations per minute provides a very satisfactory binding. Experimentation has shown that the rate of oscillation may be decreased or increased well beyond that rate. We hve found that oscillation of the book in this manner provides the desired slashing and at the same time provides a mechanical jogging of the pages in the book assuring exceptionally good alignment of the sheets during the binding operation.

The book is maintained in a generally upright condition in the apparatus of FIGS. 10 and 11 by a pair of side walls 50, 51 which are carried by respective pairs of support brackets 52, 53. The brackets 52, 53 are reciprocally carried by a screw 55 rotatably supported in trunnion supports 56, 57 and threaded in blocks 58, 59 with counter pitch threads so that upon rotation of the screw 55 in the clockwise direction by a knob 60 the blocks 58, 59 will move toward each other to press the walls 50, 51 slightly against the book 10, and, alternatively, rotation of the knob 60 in the counterclockwise direction will cause the blocks and hence the walls 50, 51 to separate. The brackets 52, 53 carry respective resiliently mounted rollers 62, 63. As can be seen in FIG. 10, the roller 63 is rotatably carried on springs 64 which are in turn bolted to the brackets 53, as at 65. This arrangement provides that the initial contacts between the walls 50, 51 and the book 10 are at the spring-carried rollers 62, 63 assuring that the edges of the outermost pages are properly in contact with the adhesive, as can be seen in FIG. 11. The distance between walls 50, 51 should be as great as the width of the backbone to permit removal without adjustment of knob 60. The arrangement provides a generally upright condition of the paper being bound rather than any true pressure clamping.

Preferably, the heater 33 is powered electrically under the control of a thermostat 70. A limit switch 71 is provided with a contact finger 72 which, upon adjustment of the knob 60 to provide positioning control for the book 10, will close the switch 71 whenever a book is inserted for binding. Closure of the switch 71 preferably closes the circuit to a timer and the motor 44 thereby oscillating the heater 33 for a timed period. In our actual experience, we have found that the heater may be typically maintained at a temperature on the order of 325° F, a temperature which it will ordinarily reach in approximately 2 minutes following initial turn-on of the heater circuit. With a typical paper cover of a thickness on the order of 0.012 inches and adhesives to be described below, a timer indicating approximately 12 seconds will properly direct removal of the book. However, under the same circumstances we have found that the book may remain in position up to approximately 30 seconds without scorching or deleteriously effecting the adhesive in a typical situation. A reset button in the microswitch circuit may be employed to require manual reset following each binding operation in order to assure proper sequencing of the timer, although it is clear that the timer is not essential to the successful operation of the apparatus. In fact, it will be clear to those skilled in the art that if desired, the heater may be oscillated continuously and the operator may merely insert and remove the books following a visual observation of the time lapse. As in the case of the hand method described with respect to FIGS. 1 through 8, a separate chill block may be employed for cooling the bound books. This cooling requires less than 1 minute, after which the books may be put into use.

An examination of adhesive materials that are satisfactory for the present method shows that a large number of so-called "hot-melt" adhesive having in the range of 20 – 40 percent of ethylene vinyl acetate of a medium to high viscosity in combination with about 20% tackifier, ordinarily a natural rosin, with the balance of microcrystalline wax as a carrier with a melt point on the order of 150° – 160° F may be used. It is desirable that the melt temperature of the adhesive composite approximate 220° F, and that the adhesive be remeltable so that additional pages may be added later, if desired.

A typical cover may, as above noted, comprise a paper, card, or similar stock. Preferably, the backbone 11 is then spread with a layer of the thermally activated or hot-melt adhesive. A layer of 0.035 inches in thickness has proved eminently satisfactory. We have found that in spite of the fact that linear polyethylene material, sometimes used in book binders, has poor adhesion to conventional glues, it very satisfactorily sticks to the hot melt adhesive above described and provides a practically indestructible cover far superior to any heretofore employed. Further, we have found that the application of such a cover, with its adhesive, to a heater at a temperature on the order of 325° F for the relatively short period of time described above, does not in any way adversely affect the cover or its contents.

From the above description, it will be apparent that several variations will very satisfactorily be used without departing from the novel concepts of the present invention. For example, the adhesive may be initially stuck to the backbone by applying it thereto in a melted condition by hot-melt applicators such as marketed by Nordson Corporation or Amherst, Ohio. Alternatively, it may be mechanically tacked or otherwise held to the backbone prior to the book heating step. Likewise, the adhesive may be marketed as a separate strip in the form of scrim (loosely woven fiber of the type commonly found as a reinforcement for gummed paper pad backing) impregnated and surrounded by the hot-melt adhesive to a combined thickness on the order of 0.030 to 0.040 inches. Under the latter circumstance, a plain cover without adhesive may be prepared for insertion into the apparatus the plastic layer laid upon the backbone, and the sheets rested thereupon, the whole combination being then lowered onto the heater for permanent assembly into a book.

We have illustrated a backbone 111 and a heater arranged to cooperate therewith, both of which are essentially flat. Clearly, the backbone may be slightly curved, if desired, in which event a somewhat curved heater is also preferred in order to more effectively and efficiently transfer heat when heating or ooling. When the backbone is of yieldable material, such as paper, the heater may be flat as shown and the surface 27 of the chill block 25 curved to provide a very satisfactory curved-back binding following the cooling operation.

It will also be clear that the heater surface may be made flexible and bowed upwardly, then downwardly to provide sliding action between the sheets, rather than tilting, as in the illustrated embodiment. It is important in the most effective accomplishment of the invention that the sliding action between adjacent sheets may be accomplished to provide adhesive coaction with the sides as well as the ends of the individual sheets being bound. We have found, however, that loose handling of the sheets can provide an adequate binding without slashing when sheets having little or no tendency to cling together are being bound.

Many uses have been determined for the bindings successfully constructed in accordance with the present invention. Acetate sheets, flexible vinyl, polyvinylchloride, and similar materials have been found to satisfactorily attach to the hot melt adhesives herein employed. Accordingly, photographic album pages, and the like, are readily bound. We have found that clay-coated papter, which has previously been difficult to bind in books, has been found to adhere well, permitting the accumulation of a number of issues of magazines (considering each magazine as a sheet) into a permanent binding. Likewise, photographs per se have been found to bind very satisfactorily directly to the hot melt adhesives in accordance with the method and apparatus described herein.

The release layers 18, 19 may comprise any material that does not adhere to the hot melt adhesive. Examples are Quilan C (the trademark of E. I. duPont de Nemours for its chrome complex in isopropanol) in a dilute solution of 5 parts per 100 parts isopropyl alcohol; or Syl-Off 23 (trademark of Dow Corning) diluted to 5% in Xylene; or FC805 fluorochemical (trademark of Minnesota Mining & Manufacturing Company for its chromium complex of long chain fluorochemical compound diluted to 5% with water or alcohol. Different choices of hot melt adhesives may, of course, make different release compounds desirable.

Figure 12:
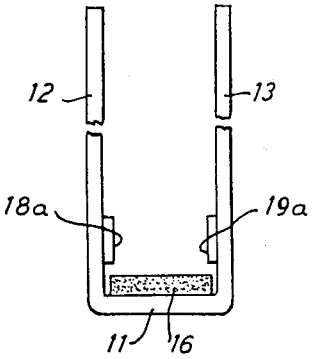
FIG. 12 is an end-elevational view of a cover, in binding position, of a modified form of the inventive structure.
Figure 13:
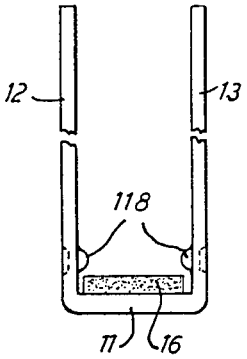
FIG. 13 is an end-elevational view of a further modified form of cover constructed in accordance with the present invention.
Figure 14:
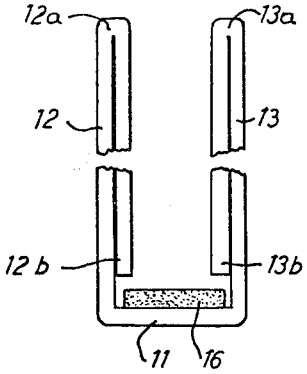
FIG. 14 is an end-elevational view, partially broken away, illustrating a yet another modified form of bookbinding cover in accordance with the present invention.

As discussed above, and as illustrated clearly in FIG. 11, the rollers 62, 63, provide a means for assuring that the top and bottom pages of a bound book do, in all cases, contact the adhesive or cement 16 during the heating operation. The roller means operate very satisfactorily in situations where the covers 12, 13 are somewhat flexible so that they are able to assume the somewhat indented condition shown in FIG. 11. We have found, however, that the addition of temporary, or permanent, means to the inner surfaces of the cover material will very satisfactorily assure "last page" contact with the cement at the time of heating. Several techniques are illustrated in FIGS. 12 through 19 for accomplishing this purpose. As shown in FIG. 12, the release strips 18*a* and 19*a* may be made of relatively substantial thickness, or separate spacing strips may be added to the inside surface of the covers to provide a mechanical projection assuring that the last pages to be bound, either on the top or bottom of the book, assuredly contact the cement 16. When cover 12, 13 is constructed of permanently deformable materials such as thermoplastic materials, inwardly projecting dimples 118 may be provided to accomplish the same purpose. Similarly, as shown in FIG. 14, the cover material 12, 13 may be folded as at 12*a*, 13*a*, respectively, to extend to a position adjacent the cement 16 and slightly overlying the cement to provide an integral spacer at 12*a*, 13*b*.

Figure 15:
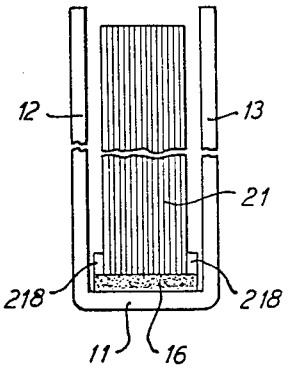
FIG. 15 is an end-elevational view of still another embodiment of book-binding cover constructed in accordance with the present invention and illustrating the utilization of separate inserts.

The spacers may, of course, comprise substantially the same material as the pages being bound and may be loosely laid upon the cement as at 218 shown in FIG. 15. As there shown, the strips 218 may be inserted into the position illustrated at the time the pages 21 are inserted for binding. When the cement 16 is then heated, the strips 218 will be bound into the cement along with the pages 21, thereby positively assuring that the last page is in every case cemented properly.

Figure 16:
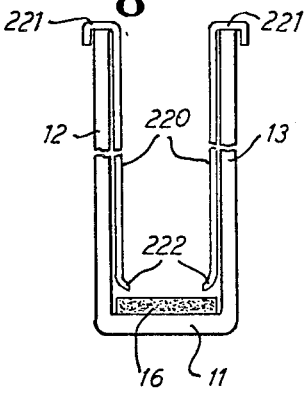
FIG. 16 is an end-elevational view of a book-binding constructed in accordance with the present invention and utilizing separable page-positioning plates.

Temporary means may also be provided for positively, mechanically, positioning the last pages of the book in contact with the cement. As shown in FIG. 16, a pair of plates 220 may be provided with turned-over edges or hooks 221 and inturned edges 222 for cooperation with the upper edges of the covers 12, 13 and the last pages of the book to be bound, respectively. Upon completion of the binding operations, the plates 220 are withdrawn and inserted in the next book to be bound. The plates 220 do not contact the cement and may be constructed of substantially any material capable of permanently retaining the cross-sectional configuration illustrated in FIG. 16.

Figure 17:
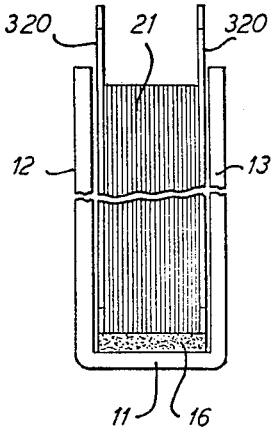
FIG. 17 is an end-elevational view of a further embodiment employing separable positioning plates in the binding operation in accordance with the present invention.
Figure 18:
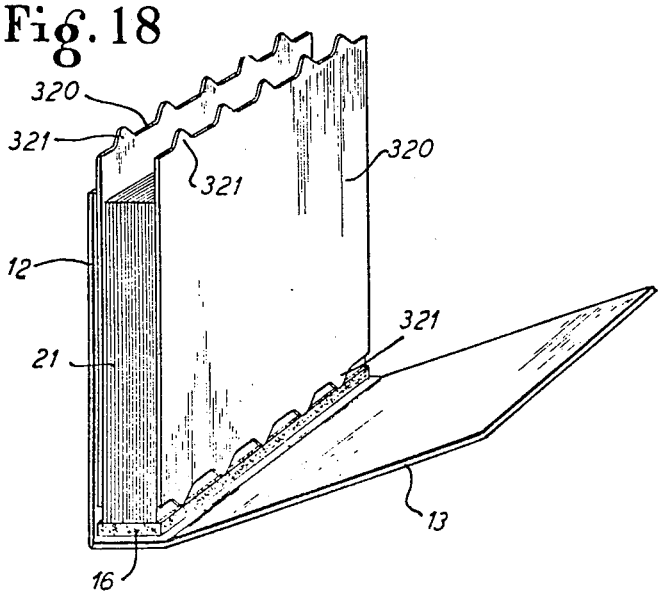
FIG. 18 is an isometric view illustrating the utilization of the plates as seen in FIG. 17.
Figure 19:
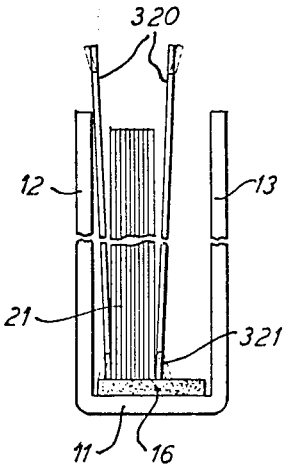
FIG. 19 is an end-elevational view of the structure in accordance with FIG. 1. 17 with the separable plates in a further position.
Figure 20:
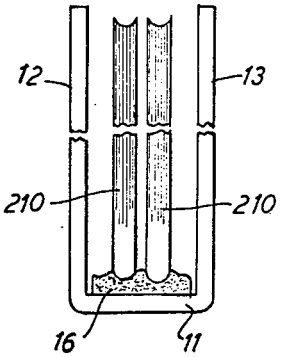
FIGS. 20, 21, 22 and 23 illustrate an end-elevational view of a binding element constructed in accordance with the present invention wherein an additional intermediate bound member is inserted and bound in sequential steps.

We have found that the plate 220 may, if constructed of a relatively rigid impermeable material, such as aluminum, or the like, actually contact the cement 16 with becoming permanently bonded thereto. An embodiment of such as construction is shown in FIGS. 17, 18 and 19. As there shown, plates 320 are provided with either rounded or pointed projecting bumps 321 along at least one edge thereof. The plates are placed, as illustrated in FIGS. 17 and 18 between the covers 12, 13 and the last pages of the group of pages 21 being bound. The projections 321 are of inconsequential area insofar as their contact with the cement 16 is concerned and following the heating operation they may readily be physically pulled away from the cement 16. During the heating, however, the plates 320 provide positive placement of the last pages in contact with the cement 16. In order to assure physical removal of the plates 320 from the cement 16 following the bookbinding operation, the plates may be coated with release material such as TEFLON or the like, but it will be understood that uncoated metal materials have proven very satisfactory in actual use even without such coating materials thereon.

Utilization of plates 320 as illustrated in FIG. 18 also provides a superior means for binding a small number of pages in a relatively large-back binder. When it is desired to utilize a binder such as that illustrated, for continuously keeping or collecting papers, the papers may be readily added at any time by merely replacing the cover in the heating apparatus. As illustrated in FIG. 19, a relatively small number of pages 21 may readily be assembled with the cover for heating, and the small projections 321 embed themselves in the cement 16 sufficiently to provide a relatively close assembly of the pages 21 adjacent the cement 16 even though the bookbinding is substantially larger than the group of pages 21 then being bound. The tabs 321 may be deflected, as shown in dotted lines in FIG. 19, and when so bent the plates 320 even more positively position the pages inwardly of the covers 12, 13 in contact with cement 16.

Figure 21:
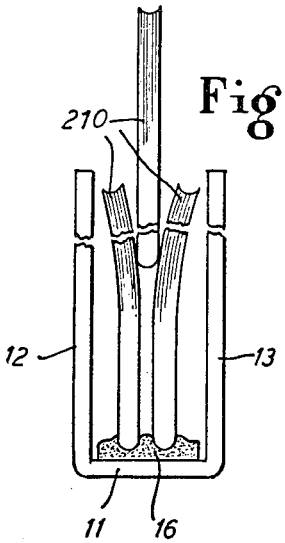
Figure 22:
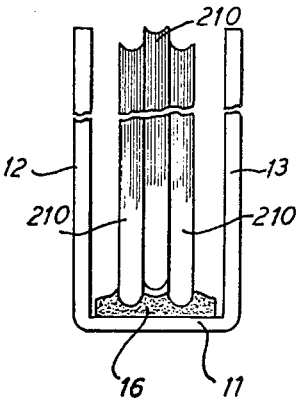
Figure 23:
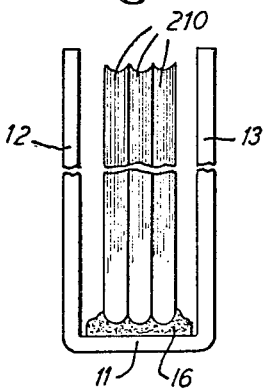
Figure 24:
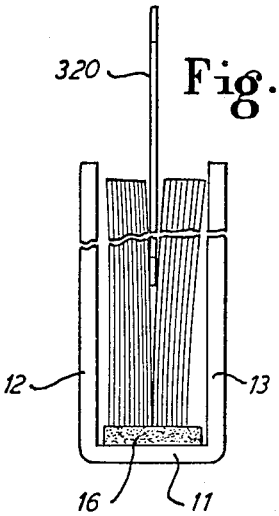
FIGS. 24, 25, 26 and 27 illustrate the method of the present invention whereby an additional single or small number of addtional pages may be inserted within the main body of the bound pages, all in accordance with the present invention.
Figure 25:
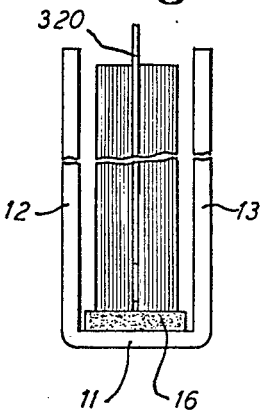

As above pointed out, we have found that reheating the book after it is bound will readily permit the addition of extra sheets to the binding. In the case of the assembly illustrated in FIG. 19, the additional sheets may merely be added at one side or the other of the already bound sheets. In some cases, it may be desirable, however, to insert additional pages between previously bound sheets. Such an arrangement is illustrated in FIGS. 20 through 23. As there shown, a pair of magazines 210 are shown in a previously bound condition. A third magazine 210 is inserted, as shown in FIG. 21 while the cover is in position in contact with the heater of an apparatus such as shown in FIGS. 10 and 11, and, while the heater is in operation, the magazine is lowered into contact with the cement 16. As shown in FIG. 22, during the heating operation, the weight of the center magazine 210 causes separation of the outer magazines 210 with the cement 16 in a flowable condition, resulting in a final positioning of the magazines as shown in FIG. 23. When the heat is removed, or the cover placed upon the chill block as previously described, the final bound book has accepted an additional magazine, or the like, and may accept still additional ones at any later time through a repetition of the same method.

Figure 26:
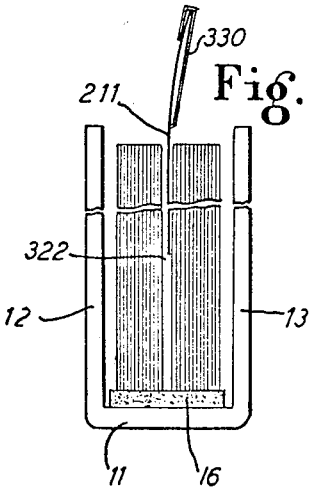
Figure 27:
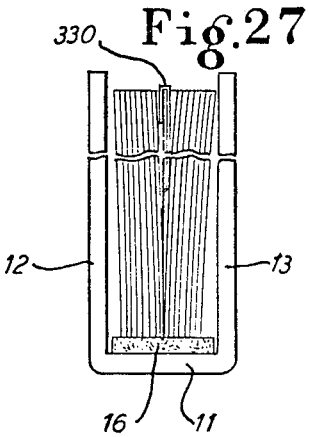

In the description of FIGS. 20 through 23, the inserted additional material comprised a relatively heavy product such as a magazine. When a single page is desired to be inserted into a book, the page may not be sufficiently heavy in its own right to jog down into intimate contact with the cement 16. In such cases, insertion may be accomplished by means of a weight plate and a separator plate. As shown in FIGS. 24 through 27, a previously bound book is placed upon the heater and a separator plate inserted, as shown, at the place where a sheet is to be inserted. The separator plate may take the form of a plate 320 with projections 321, and is sufficiently heavy to settle downwardly between adjacent pages of the bound book into contact with the cement 16. This settling action occurs readily when the cement is in its relatively fluid, heated, state and when the separator plate is withdrawn a small space as shown at 322 in FIG. 26 remains into which an individual sheet 211 may be inserted readily. A bent-over weight plate of thin metal, 330, may be hung over the individual sheet as shown in FIG. 26 and as a result of this added weight, the sheet 211 jogs downwardly into intimate contact with the cement 16 and is bound into the booklet in substantially exactly the same manner as it would have been had it been inserted at the time of the original binding operation. Of course, upon completion of the additional step, the weight plate 330 is removed, and set aside for a subsequent, similar operation.

It will be seen from the above description that additions and deletions from the book of the present invention are readily accomplished, and that no pages of the book will be out of contact with the cement. It has been found, also, that a plurality of books may be simultaneously heated, and hence permanently assembled, in the apparatus illustrated. As a result, a completely flexible book binding system has been accomplished.

In view of the numerous variations clearly possible, it is our intention that the scope of the present invention be limited solely by that of the hereinafter appended claims.

We claim as our invention:

1. The method of binding a plurality of sheets along one edge thereof which comprises: resting said sheets generally vertically on said one edge in a loose, unclamped, condition on a layer of thermally activatable adhesive supported on a backbone, heating said adhesive to melted condition sequentially cyclically lifting only one side portion of said backbone and the sheets supported thereon relative to the opposite side portion and the sheets supported thereon then lifting the the opposite side portion and the sheets supported thereon while lowering said one portion and the sheets supported thereon, thereby cyclically sliding adjacent sheets up and down relative to each other while in contact with the adhesive and while said adhesive is in heated and melted condition so that opposite sides of the sheets adjacent said edge resting on the adhesive are coated with the adhesive, and cooling said adhesive while maintaining said backbone generally perpendicular to the plane of said sheets.

2. The method set forth in claim 1 including the step of positively locating and holding the first and last of said sheets adjacent the backbone into contact with said adhesive.

3. The method of claim 2 wherein covers are flexibly secured to said backbone and wherein separate means are inserted between the cover and said last pages during thermal activation of the binding.

4. The method of claim 2 wherein separate means are inserted between the cover and said last pages during thermal activation of the binding and removing said separate means after cooling.

5. The method of inserting an additional leaf in a book having sheets bound to a backbone by a heat activatable adhesive comprising the steps of heating the backbone while the book is resting thereon with the sheets thereof in a generally upright condition, to melt said adhesive inserting said leaf between adjacent sheets until an edge thereof rests on said adhesive and applying a downward load to said leaf simultaneously with cyclically lifting one side portion of the backbone with the sheets thereon and relatively lowering the opposite side portion thereof and the sheets thereon by pivoting said backbone about an axis generally parallel thereto so that the opposite sides of said leaf adjacent said edge resting on the adhesive are coated with said adhesive.

* * * * *